US005364327A

United States Patent [19]

Graham

[11] Patent Number: 5,364,327

[45] Date of Patent: Nov. 15, 1994

[54] EXERCISE APPARATUS COMPRISING AN ADJUSTABLE KICKPLATE ASSEMBLY

[76] Inventor: Gary A. Graham, Box 2000, Glacier, Wash. 98244

[21] Appl. No.: 1,958

[22] Filed: Jan. 6, 1993

[51] Int. Cl.[5] ..... A63B 21/02

[52] U.S. Cl. ..... 482/122; 482/129; 482/133

[58] Field of Search ..... 482/72–73, 482/95, 96, 121–123, 13, 51–53, 54, 70, 91, 111, 114, 141, 148, 907, 133, 129

[56] References Cited

U.S. PATENT DOCUMENTS

| | | | |
|---|---|---|---|
| 203,973 | 5/1878 | Wilcox | 482/72 |
| 208,954 | 10/1878 | Bryon, Jr. | 482/72 |
| 242,073 | 5/1881 | Terry | 482/72 |
| 355,266 | 12/1886 | Heibecker | 482/72 |
| 1,750,549 | 3/1930 | Thomson et al. | 482/72 |
| 1,996,350 | 4/1935 | Schaff | 482/96 |
| 3,589,720 | 6/1971 | Agamian | 482/132 |
| 4,706,953 | 11/1987 | Grahm | 482/96 |
| 4,880,224 | 11/1989 | Jonas et al. | 482/72 |
| 4,884,802 | 12/1989 | Graham | 482/96 |
| 5,066,005 | 11/1991 | Luecke | 482/96 |
| 5,169,363 | 12/1992 | Campanaro | 482/96 |

FOREIGN PATENT DOCUMENTS

| | | | |
|---|---|---|---|
| 0048115 | 12/1933 | United Kingdom | 482/96 |
| 9200780 | 1/1992 | WIPO | 482/72 |

*Primary Examiner*—Richard J. Apley
*Assistant Examiner*—Jerome Donnolly
*Attorney, Agent, or Firm*—Robert W. Jenny

[57] ABSTRACT

The exercise apparatus comprises a track assembly, a carriage movable on the track assembly and a kickplate assembly attached to the track assembly. The carriage is resiliently restrained to move toward one end of the track assembly. The kickplate assembly can be adjusted to be anywhere along the track assembly and the position of the kickplate on the kickplate assembly can be adjusted to vary its distance above the track assembly.

2 Claims, 2 Drawing Sheets

EXERCISE APPARATUS COMPRISING AN ADJUSTABLE KICKPLATE ASSEMBLY

BACKGROUND OF THE INVENTION

1. Field

The subject invention is in the general field of apparatus used by people for exercising. More specifically it is in the field of such apparatus in the use of which the user is supine, resting on a carriage which is movable in the user's head/feet direction on a track assembly comprising one or more rails or tracks. Still more specifically it is in the field of such apparatus in which the motion of the carriage (and user) is under the influence of variable restoring forces provided by springs, shock cords and the like and the motion of the carriage and user is generated by use of the user's legs or arms, particularly by use of the user's leg(s) and foot or feet against structure attached to the track assembly and termed a kickboard.

2. Prior Art

The most applicable prior art known to the inventor of the subject invention is disclosed in U.S. Pat. Nos. 4,706,953 and 4,884,802 issued to him. Both cover exercise apparatus comprising a platform rolling on parallel tracks in a track assembly and a kickplate, termed a panel 21 in U.S. Pat. No. 4,884,802 as shown in FIG. 1 in this disclosure. The user lies supine on the platform with one or more of his or her feet in position to be placed against and apply force to the kickplate to set the platform and user in oscillating motion on the track frame. U.S. Pat. No. 1,950,174 shows prior art apparatus of this type without a kickboard but having tension members between the user's hands and feet and structure mounted on a track assembly.

It has been learned in the use of apparatus of the type shown in FIG. 1 that the location of the points of contact of user's feet while exercising has significant influence on the results and success of use of the apparatus. For example, for dancers wanting to simulate jumping with heels and toes of the feet in contact with a support or for people with certain coordination difficulties it is helpful to position the kickboard low, i.e. relatively close to the plane of the parallel tracks so that the points of contact of feet on the kickboard are also low. Otherwise, for athletes working to increase their jumping ability with their heels unsupported (i.e. not in contact with the kickplate) it is useful to position the kickplate high so that the contact points of feet on the kickboard are further away from the plane of the track assembly.

It has also been learned that the utility of the subject type exercise apparatus is extended by arranging for the user to be able to activate the apparatus by pulling on the kickplate. Such an arrangement requires that the kickplate be positioned at the end of the track assembly opposite from the end at which it is attached for activation by pushing and by providing attachment points on the kickplate for pulling (negative force) apparatus (shoes or harnesses) worn on the user's feet.

Accordingly, the prime objective of the subject invention is to provide apparatus of the described type having an adjustable kickplate. Another objective is that the kickplate construction and adjustment enable use of the exercise apparatus using negative force activation. Other objectives are that the kickplate and its adjustment means be of simple construction and simple to operate relative to the effectiveness of the adjustments.

SUMMARY OF THE INVENTION

The subject invention is an exercise apparatus having an adjustable kickplate assembly. The exercise apparatus comprises a parallel track assembly, a carriage moveable on the assembly and the kickplate assembly used in setting the carriage in motion. Shock cords or the like are incorporated in the exercise apparatus to resiliently resist motion of the carriage away from the end of the track assembly at which the kickplate assembly is usually attached. The kickplate assembly comprises a support frame which is adapted to be fastened to the outer sides of the tracks of the track assembly and support a flat kickplate with its flat surfaces perpendicular to the plane of the track assembly. In a preferred embodiment of the invention the kickplate support frame comprises two subassemblies, each having a base number, a vertical member and a brace member. The vertical member is attached at a right angle to one end of the base member. The brace member is attached to the other end of the base member, is angled toward the vertical member to come into contact with it approximately at its midpoint and then bent to extend upward and in contact with the vertical member with the top ends of the vertical and brace members coplanar. The subassemblies are joined together, by two horizontal cross members, one at the top ends of the subassemblies and the other parallel to it and spaced from it a distance equal to approximately one third of the height of the subassemblies. The base members of the subassemblies and the subassemblies are parallel to each other, respectively. The support assembly further comprises two straight structural members, attached one each to the base members of the subassemblies. One end of each straight structural member is near the end of the base member to which the structural member is attached and the other end extends beyond the other end of the base member a distance approximately equal to the length of the base member. These straight structural members engage the grooves in the I-beams which form the tracks of the track assembly so that the support assembly can be moved along the track assembly and fastened to it at any point along it.

The kickplate is flat and rectangular. One broad face is made of hard material such as plywood and the other broad face is cushioned, such as with vinyl covered foam.

Four threaded fasteners extend normal to the back of the kickplate and fit through holes in the vertical members of the support frame and the kickplate is held in place on the frame by easily handled nuts, such as wing nuts or threaded knobs, on the fasteners. The four fasteners are located at the four corners of a rectangular hole pattern and the hole pattern is offset closer to one of the long edges of the kickplate than to the other. As a result, the kickplate can be attached to the frame with the long edge farthest from the fastener pattern either up or down. With it up the kickplate is mounted in its higher position relative to the plane of the track assembly and with the edge down the kickplate is closer to the plane of the track assembly. In its higher position the kickplate is used for simulating jumping with the user's heels not contacting the kickplate. In its lower position the kickplate is used for simulated dancing and the like with full foot contact with the kickplate.

For exercises in which tension forces rather than pressure forces are applied to the kickplate assembly, the assembly is moved to the end of the track assembly opposite to the end to which the kickplate assembly is usually attached. With the kickplate assembly in this location the shock cords and the like resiliently resist motion of the carriage toward the kickplate assembly, specifically the non cushion side of the kickplate, so that the user must apply tension to the assembly to move toward the assembly. This requires attaching one or more of the user's feet to the assembly. This is done using shoes or foot harnesses incorporating hooks or the like which engage one or the other of the crossmembers on the support structure.

The invention is described in more detail below with reference to the attached drawings.

BRIEF DESCRIPTIONS OF THE DRAWINGS

DETAILED DESCRIPTION OF THE INVENTION

The subject invention is an exercise apparatus which comprises a carriage moveable on an assembly having parallel tracks and a kickplate assembly attached to the track assembly. The carriage also comprises means for resiliently restraining the apparatus to move toward a first end of the track assembly. The kickplate assembly is mounted on the track assembly so that a user of the apparatus can move the carriage against the resilient restraint by (1) pushing with one or two feet on the kickplate when the kickplate is mounted at the end toward which the restraint tends to move the carriage or (2) by pulling on the kickplate assembly when it is mounted at the other end of the track assembly. The kickplate is oriented perpendicular to the plane of and long axis of the track assembly and a distance above the track assembly with the distance being adjustable.

Figure 1:
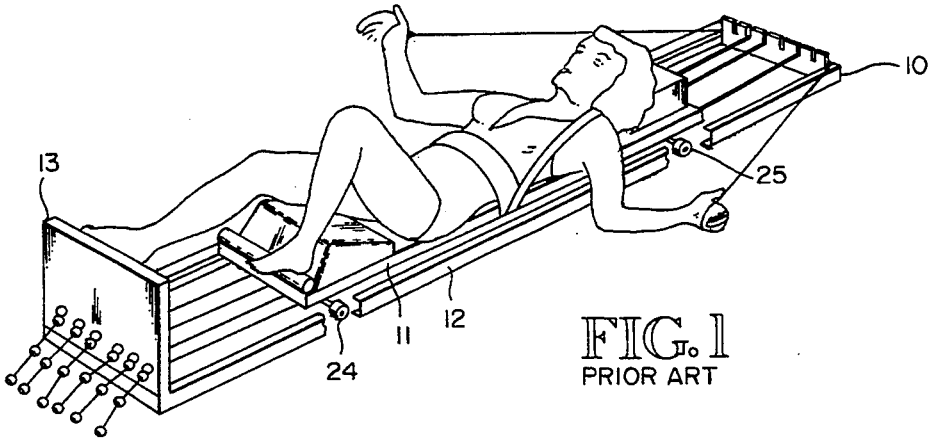
FIG. 1 PRIOR ART
FIG. 1 illustrates exercise apparatus which is prior art to the subject invention.
Figure 2:
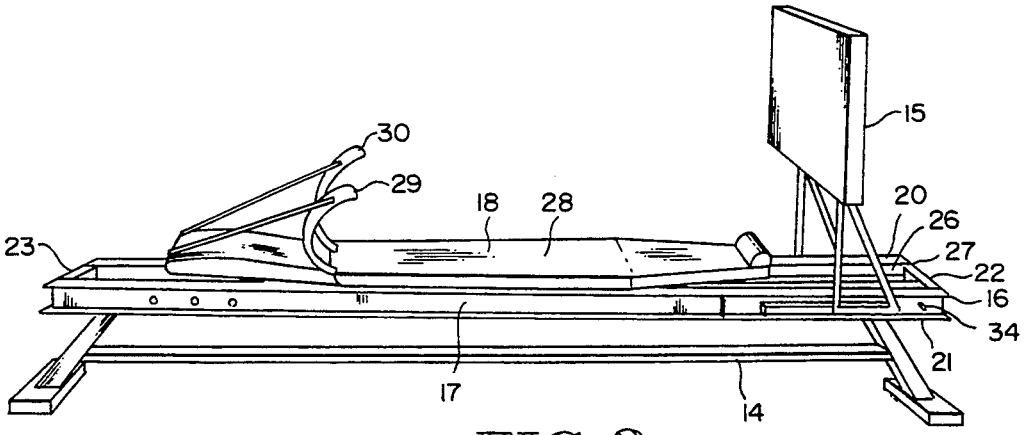
FIG. 2 is a perspective illustration of exercise apparatus with the kickplate assembly mounted such that the carriage is resiliently restrained to move toward it.

FIG. 1 illustrates prior art apparatus 10 comprising a carriage 11 movable on a track assembly 12 and comprising a fixed kickplate 13. The subject apparatus 14 is shown in FIG. 2 with kickplate assembly 15 attached to end 16 of track assembly 17 of exercise apparatus 14. Carriage 18 moves along the track assembly and is resiliently restrained to move toward end 16.

Figure 3:
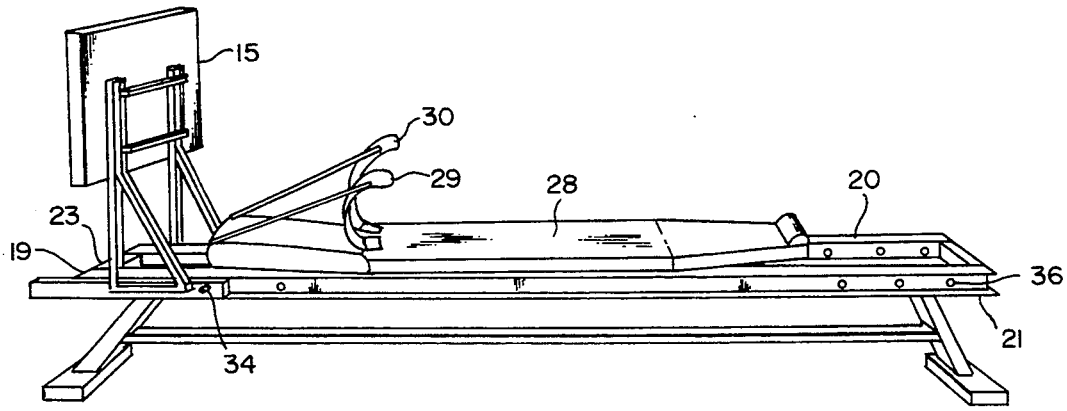
FIG. 3 is a perspective illustration of the apparatus of FIG. 2 with the kickplate assembly positioned such that the carriage is resiliently restrained to move away from it.

FIG. 3 illustrates the subject kickplate assembly attached at end 19 of the track assembly.

The track assembly comprises two parallel I-beam rails 20 and 21 interconnected by cross members and 23. The carriage 18 is similar to carriage 11 in the prior art apparatus and has rollers similar to rollers and 25 in the prior art engaging the inner channel shapes of the I-beam rails. Bungee cords 26 and 27 provide the resilient restraint of the carriage toward end 16. The carriage comprises a framework, not visible in these views, to which the rollers are attached, and pad 28 equipped with shoulder supports 29 and 30.

Figure 4:
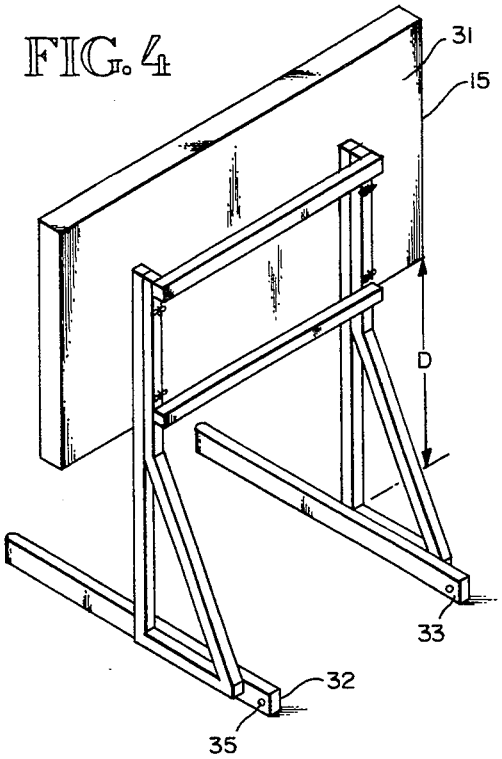
FIG. 4 is a perspective view of the kickplate assembly with the kickplate in its higher position.
Figure 5:
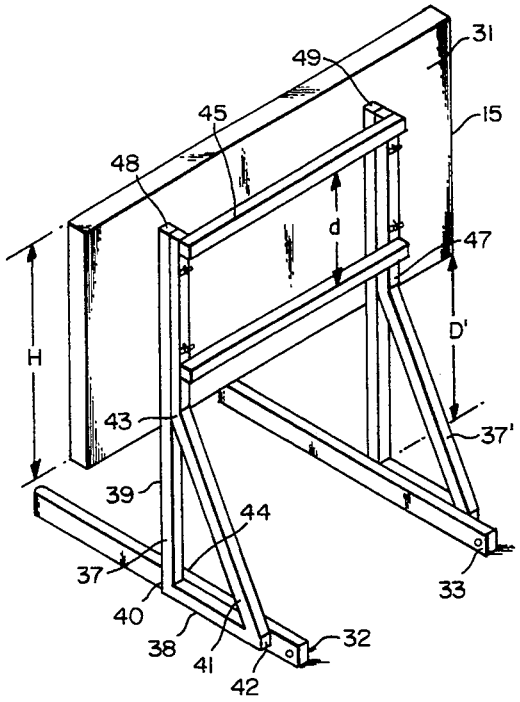
FIG. 5 illustrates the kickplate assembly with the kickplate in its lower position.

FIG. 4 illustrates kickplate assembly 15 with kickplate 31 attached a distance D from structural members 32 and 33. FIG. 5 illustrates assembly 15 with kickplate 31 attached a distance D′ from structural members 32 and 33.

Assembly 15 is movable to any position along the lengths of the rails with members 32 and 33 in the outer channel portions of the I-beam rails. The assembly is fixed in particular positions by inserting rod 34 through holes in members 32 and 33, hole 35 being typical and aligned holes in the rails, hole 36 being typical. Set screws or clamp apparatus can also be used to hold the kickplate assembly in position on the track assembly.

Assembly 15 comprises subassemblies 37 and 37′. Each sub assembly comprises a base member 38, a vertical member 39 attached at 90° to the base member at end 40, a brace 41 attached at end 42 of the base member and to the vertical member at 43 and a structural member 32 aligned with and attached to the base member with its midpoint 44 near end 40 of the base member. The subassemblies are made right and left hand and attached to each other by crossmembers 45 and 46 to form support assembly 47, member 45 being at the top ends 48 and 49 of the subassemblies and member 46 attached a distance d from ends 48 and 49. Distance d is in the range of $\frac{1}{2}$ to $\frac{3}{4}$ of the height H of the kickplate 31.

Figure 6:
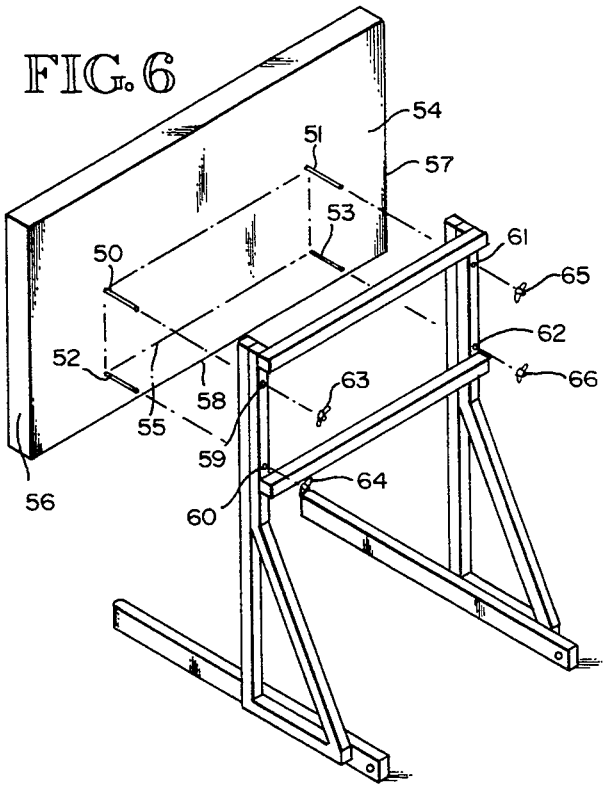
FIG. 6 illustrates the kickplate removed from the support assembly to more clearly indicate the fastening of the kickplate to the support structure.

FIG. 6 illustrates one embodiment of means for attaching the kickplate to support assembly 47. Threaded fasteners 50, 51, 52, 53 and 54 extend from back 40 of the kickplate and are positioned at the corners of a rectangular pattern 55 indicated by the phantom lines. The pattern is centered between ends 56 and 57 of the kickplate assembly but offset toward side 58 of the kickplate. These fasteners fit through holes 59, 60, and 61 and 62 in assembly 47 and the kickplate is fastened to support assembly 47 by wing nuts 63, 64, 65 and 66. Because the pattern is offset, the kickplate can be mounted as shown in FIGS. 2 and 3 or, inverted and mounted as shown in FIG. 5.

Figure 7:
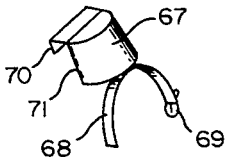
FIG. 7 illustrates apparatus usable in attaching a foot to the kickplate assembly.

FIG. 7 illustrates a harness usable for attaching a foot to cross member 45 or 46. Stirrup 67 fits around the instep of a user's foot and strap 68 with buckle 69 fits around user's ankle to hold the stirrup in place. Hook 70 is attached to bottom 71 of the stirrup and is used to engage a cross member.

In one mode of use of the exercise apparatus, with the subject kickplate assembly installed at the end of the apparatus toward which the resilient restraining means tend to move the carriage, the user lies face up on the support on the carriage with one or more feet against the kickplate. User then cyclically pushes against the kickplate, moving user, support and carriage away from the kickplate against the resisting force supplied by the resilient restraining means, and then relaxes to allow the user, carriage and support to be moved toward the kickplate by the force from the restraining means.

In a second mode the kickplate assembly is attached at the track end from which the carriage, support and user tend to be moved by the restraining means. User lies face up on the support with feet toward the kickplate assembly and with at least one foot attached to a cross member using the apparatus shown in FIG. 7, user cyclically applies tension to the kickplate assembly to move user, support and carriage toward the kickplate against the restraining force and then relaxes to allow the restraining force to move user, support and carriage away from the kickplate.

It is considered to be understandable from this description that the subject invention meets its objectives. It provides exercise apparatus of the type described having a kickplate which is adjustable in respect to its distance from the track assembly and in respect to its location longitudinally on the track assembly. The means for adjustment are of simple construction and simple to operate.

It is also considered to be understood that while one embodiment of the subject invention is described herein, other embodiments and modifications of the one disclosed are possible within the scope of the invention which is limited only by the attached claims.

I claim:

1. An exercise apparatus comprising:

a kick plate assembly, a carriage, said carriage further including a support for a user, a track assembly having a length, first and second ends further comprising first and second rails and being interconnected by said cross members and configured to be supported on a horizontal surface, means for mounting said carriage on said track assembly such that said carriage is slidably movable along said track assembly, means for resiliently restraining said carriage to move toward said first end of said track, said kick plate assembly comprising:

a support assembly, a kick plate, means for attaching said kick plate to said support assembly such that said kick plate is mounted a distance above said track assembly and said distance being adjustable and;

means for adjustably attaching said kick plate to said track such that it can be positioned anywhere along said track assembly and immovably fastened to at least the first and second ends of said track to resist a pushing force exerted on it by a user said kick plate being mounted substantially perpendicular to said track assembly, whereby with said kick plate assembly attached to said track assembly near said first end of said track, a user can lie face upon on said support and push on said kick plate with at least one of the users feet to move the user, carriage and support away from said kick plate against said means for resiliently restraining and then cease pushing to allow the user, carriage and support to be moved toward said kick plate by said means for resiliently restraining.

2. The apparatus of claim 1 in which said kickplate assembly 1 comprises first and second subassemblies and first and second kickplate assembly cross members, said first and second subassemblies being attached to each other by said first and second kickplate assembly cross members, said kickplate assembly further comprising means for attaching said at least one foot optionally to one of said two kickplate assembly cross members, whereby, with said kickplate assembly attached to said track assembly near said second end said user can lie face up on said support with said at least one foot attached to one of said kickplate assembly cross members and apply tension to said kickplate assembly to move said user, carriage and support toward said kickplate against said means for resiliently restraining and then cease applying tension to allow said user, carriage and support to be moved away from said kickplate by said means for resiliently restraining.

* * * * *